US006573660B2

(12) United States Patent
Sundahl

(10) Patent No.: US 6,573,660 B2
(45) Date of Patent: Jun. 3, 2003

(54) DRIVING EMISSIVE DISPLAYS

(75) Inventor: Robert C. Sundahl, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/846,063

(22) Filed: Apr. 30, 2001

(65) Prior Publication Data

US 2002/0158585 A1 Oct. 31, 2002

(51) Int. Cl.[7] ..... G09G 3/10; G09G 3/32
(52) U.S. Cl. ..... 315/169.3; 345/82
(58) Field of Search ..... 315/169.3, 169.4, 315/162.2; 257/40, 88, 80, 81, 82, 83, 84, 89; 345/39, 44, 46, 84, 204, 211, 82, 87, 88; 438/106, 107, 108, 109; 343/702

(56) References Cited

U.S. PATENT DOCUMENTS 4,039,890 A * 8/1977 Bailey et al. ..... 313/500
5,708,280 A * 1/1998 Lebby et al. ..... 257/88
5,737,272 A * 4/1998 Uchyama et al. ..... 345/206
5,739,800 A * 4/1998 Lebby et al. ..... 345/82
5,818,404 A * 10/1998 Lebby et al. ..... 345/82
5,886,401 A * 3/1999 Liu ..... 257/678
6,060,782 A * 5/2000 Ohsono et al. ..... 257/738
6,140,980 A * 10/2000 Spitzer et al. ..... 345/8
6,226,175 B1 * 5/2001 Murayame et al. ..... 361/680

* cited by examiner

*Primary Examiner*—Don Wong
*Assistant Examiner*—Trinh Vo Dinh
(74) *Attorney, Agent, or Firm*—Trop, Pruner & Hu, P.C.

(57) ABSTRACT

A way of driving emissive displays is provided. An apparatus comprises a first panel having one or more contacts in a pre-selected arrangement. The apparatus comprises a display panel having one or more light emitting elements and one or more contacts in the pre-selected arrangement to deliver current to the light emitting elements, wherein the contacts of the display panel are surface mounted to the contacts of the first panel.

30 Claims, 8 Drawing Sheets

DRIVING EMISSIVE DISPLAYS

BACKGROUND

This invention relates generally to displays, and, more particularly, to driving emissive displays.

Emissive displays include light emitting diodes, liquid crystal displays, and organic light emitting displays. These displays generally emit light at the pixel level that can be perceived by viewers. To drive an OLED display, electrical current is typically passed through selected pixels by applying a voltage to the corresponding rows and columns from drivers attached to each row and column. An external controller circuit typically provides the necessary input power, video data signal, and multiplex switches. Data signal is generally supplied to the column lines and synchronized to the scanning of the row lines. When a particular row is selected, the column and row data lines determine which pixels are lit. A video output is thus displayed on the panel by scanning through all the rows successively in a frame time, typically 1/60 second.

The pixels of an OLED display may be driven by drivers that are typically mounted at the edge of the display panel. In such an edge connection arrangement, it is not uncommon to find a plurality of drivers that may be located on the periphery of the display area. The edge connection arrangement, while effective, may contribute to increased line resistance and capacitance, which may adversely affect the performance of the display, such as reduced brightness. Additionally, the edge connection arrangement may sometimes call for a higher than desired voltage level to drive the pixels. In some cases, the edge connections may require significant area around the periphery of the display, thereby possibly limiting the area available for the display itself.

Thus, there is a need for an efficient way of driving emissive displays.

BRIEF DESCRIPTION OF THE DRAWINGS

The invention may be understood by reference to the following description taken in conjunction with the accompanying drawings, in which like reference numerals identify like elements, and in which.

DETAILED DESCRIPTION

Figure 1:
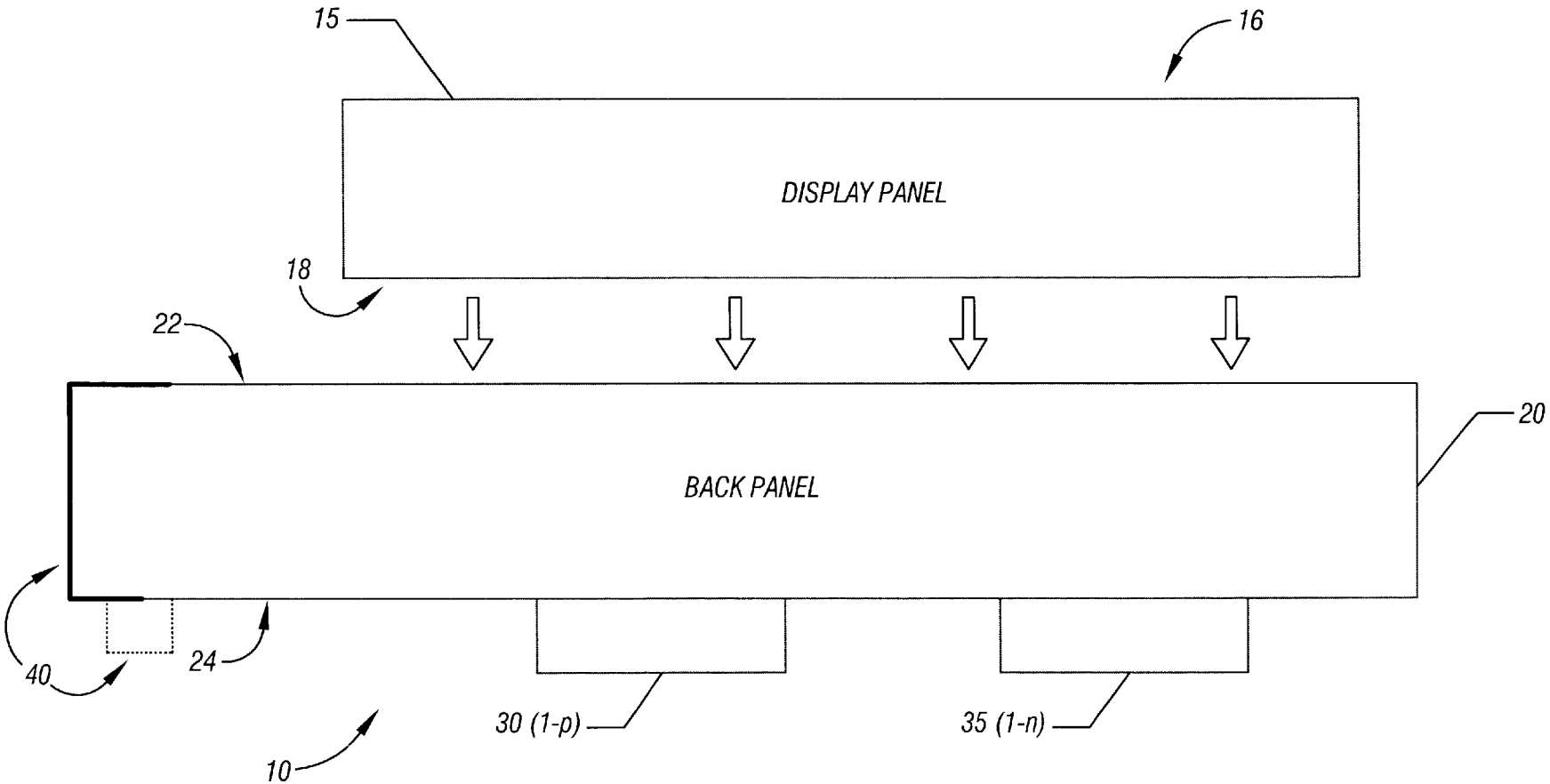
FIG. 1 is a stylized block of a module in accordance with one embodiment of the present invention.

Referring now to FIG. 1, a module 10 is illustrated in accordance with one embodiment of the present invention. In one embodiment, the module 10 includes a display panel 15 having a first and second surface 16, 18 and a back panel 20 having a first and second surface 22, 24. The first surface 16 of the display panel 15 may be a transparent layer, such as glass, for example, or, alternatively, it may be any other useful or desirable substrate. In one embodiment, the second surface 18 of the display panel 15 may include contacts that are surface mounted to contacts on the first surface 22 of the back panel 20. In one embodiment, the second surface 18 of the display panel 15 may include a two-dimensional array of contact pads that are surface mounted to a matching set of contact pads on the first surface 22 of the back panel 20. The back panel 20, in one embodiment, may be flexible.

In one embodiment, the two panels 15, 20 may be affixed to each other using ball grid array technology, where an array of contacts on the two panels 15, 20 may be combined using heat, for example, to form the module 10. The back panel 20, in one embodiment, may be constructed using ceramic, conventional circuit board or flex circuit technology. The interconnection medium between the matching contact pads on the two panels may be an appropriate solder, a conductive epoxy, an anisotropic conductive adhesive, or any other appropriate conductive material.

In one embodiment, as described in more detail below, the second surface 18 of the display panel 15 includes a plurality of electroluminescent cells, each capable of producing a pixel or subpixel of monochrome or color light. In one embodiment, one or more driver integrated circuits (also referred to as "drivers") **30(1–*p*) may be affixed to the second surface 24 of the back panel 20 for driving the plurality of cells on the display panel 15. Interconnection circuitry built on the back panel 20 may provide the desired connection between the one or more drivers 30(1–*p*) and the appropriate interconnection pads on the surface 22 of the back panel 20. In another embodiment, one or more integrated circuits 35(1–*n*) that may provide system functions (either for the display or the total system) may also be affixed to the second surface 24 of the back panel 20. The back panel may, in one embodiment, include a connector 40 that provides an electrical interface to the module 10. In one embodiment, the connector 40 may be an edge connector integrated into the back panel 20 itself. In an alternative embodiment, the connector 40 (shown in dotted lines) may be attached to the back panel 20**.

Figure 2:
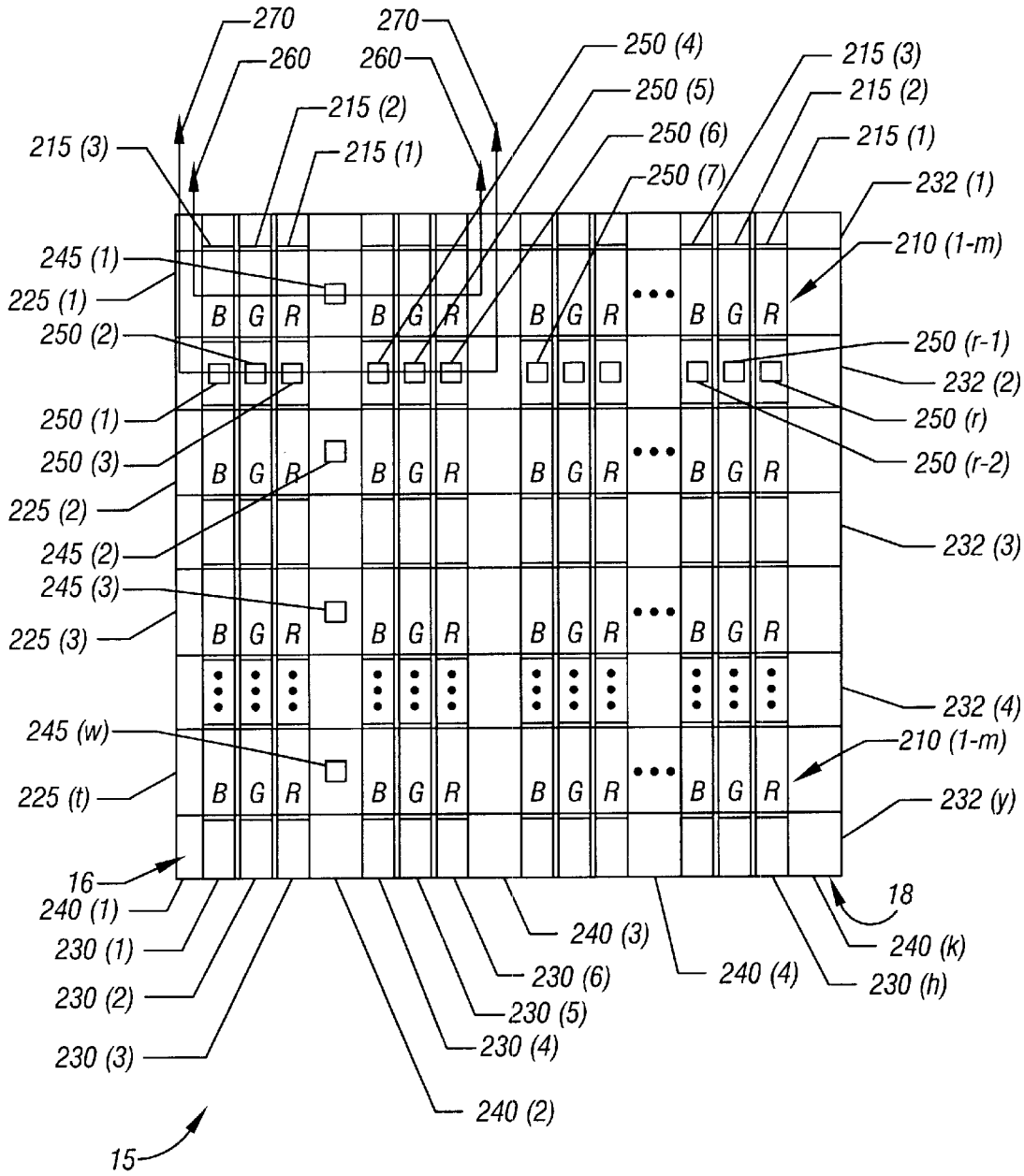
FIG. 2 illustrates a display panel that may be employed by the module of FIG. 1, in accordance with one embodiment of the present invention.

Referring now to FIG. 2, one embodiment of the display panel 15 of the module 10 of FIG. 1 is illustrated, in accordance with the present invention. The first side 16 (i.e., the topside in the illustrated embodiment) of the display panel 15 may be made of transparent material, such as glass. The second surface 18 (i.e., the underside in the illustrated embodiment) of the display panel 15 may include a plurality of electroluminescent pixels (or cells) **210(1–*m*) each including one or more light emitting elements or sub-pixels 215(1–3). In one embodiment, the light emitting elements 215(1–3) may be organic light emitting diodes. Although not so limited, in the illustrated embodiment, each cell 210(1–*m*) includes three light emitting elements, red, green, and blue lighting elements 215(1–3). Because of the transparent nature of the first side 16, the pixels 210(1–*m*) may be visible when viewing the display panel from the first side 16**.

In the illustrated embodiment, pixels **210(1–*m*) are arranged in a two-dimensional array, formed of a plurality of rows 225(1–*t*) and a plurality of columns 230(1–*h*). In one embodiment, adjacent pixels 210(1–m) are separated by at least one of a plurality of row sections 232(1–y) and column sections 240(1–k). In one embodiment, the rows 225(1–t) may be made of a film of a high conductivity metal, such as aluminum. In other embodiments a thin film of a low work function metal may also be employed. The columns 230 (1–h)**, in one embodiment, may be formed using a transparent conductive film, such as Indium Tin Oxide (ITO).

The display panel 15, in one embodiment, may have a plurality of row contacts 245(1–w) formed on one or more of the plurality of rows 225(1–t). In one embodiment, the display panel 15 includes a plurality of column contacts 250(1–r) formed on one or more of the plurality of columns 230(1–h). Although not so limited, in the illustrated embodiment, each of the plurality of rows 225(1–t) has a corresponding row contact 245(1–w) and each of the plurality of columns 230(1–h) has a corresponding column contact 250(1–r). In one embodiment, the plurality of column contacts 250(1–r) provide a signal to the anode of each corresponding light emitting element 215(1–3) of each cell 210(1–m) and the row contacts 245(1–w) provide a signal to the cathode of each corresponding light emitting element 215(1–3) of each cell 210(1–m).

The example arrangement of the row contacts 245(1–w) and column contacts 250(1–r) are provided for illustrative purposes, and it should be appreciated that, in other embodiments, one of a variety of other contact arrangements may be used without deviating from the spirit and scope of the invention. For example, in one embodiment, the column contacts 250(1–r) may be arranged in a staggered arrangement (i.e., arranged diagonally, as opposed to a horizontally). Furthermore, in one embodiment, additional or fewer contacts 245(1–w), 250(1–r) may be utilized, depending on the particular implementation goals. For example, it may be possible to have separate contacts for each of the light emitting elements 215(1–3) such that the separate contacts may serve as contacts for an active matrix display. In another embodiment, the use of thin film transistors in the display panel 15 may reduce or eliminate the need for redundant contacts, and as few as one contract per row (or column) may be needed.

In accordance with at least one embodiment of the present invention, one or more redundant contacts may be used to provide electrical signals to the pixels 210(1–m). That is, in one embodiment, additional contacts may be provided in row sections 240(3–k) and/or in column sections 232(3–y), for example, where these (redundant) contacts may also be able to deliver electrical signals to the desired light emitting elements 215(1–3) of the pixels 210(1–m). Redundant contacts may provide one of several desirable advantages. For example, redundant contacts may improve the yield of the manufacturing process, as the problems caused by faulty or otherwise inoperable contacts may be cured by using redundant contacts to provide the electrical signals to the light emitting elements 215(1–3) of the pixels 210(1–m). Additionally, using redundant contacts may assist in reducing the capacitance and/or resistance commonly associated in edge connection arrangements, particularly since the length of the lines from the drivers 30(1–p) (see FIG. 1) to the light emitting elements 215(1–3) maybe shorter.

Figure 3:
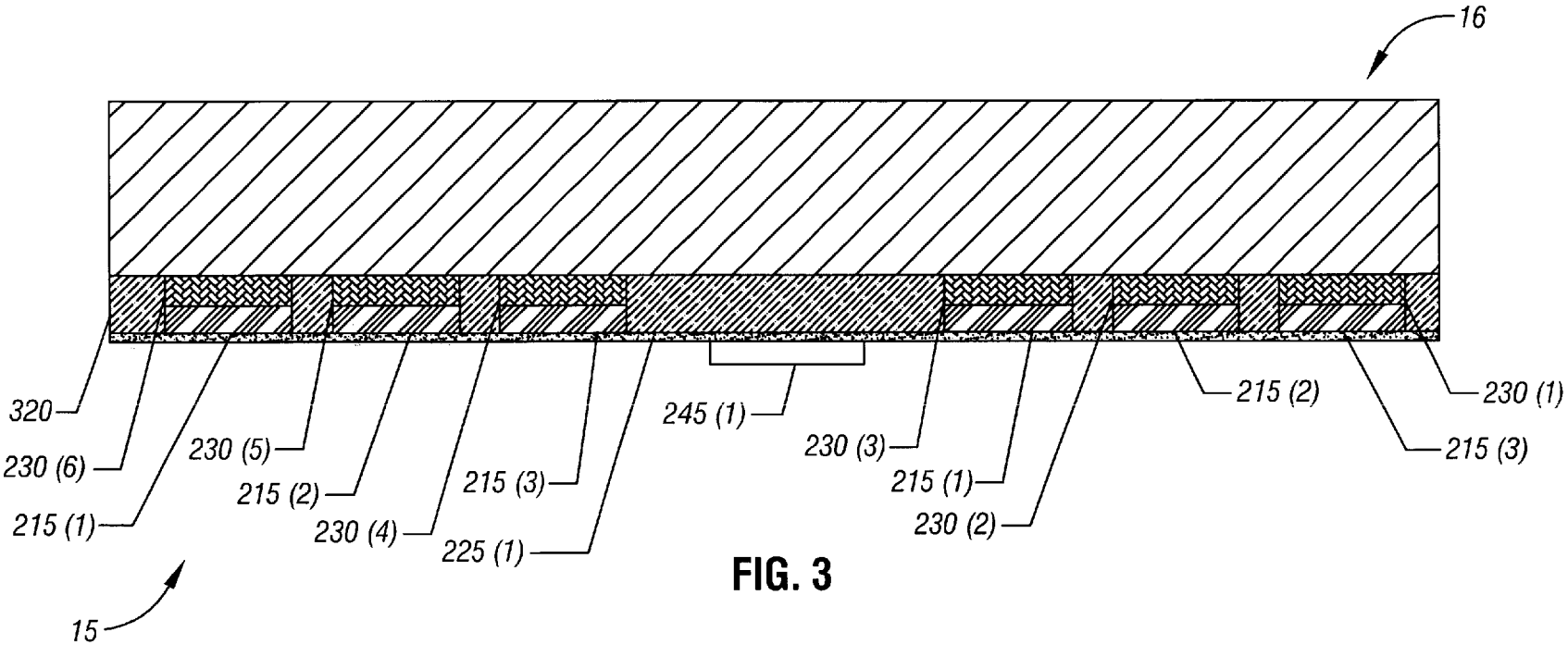
FIG. 3 is a cross-sectional view of the display panel of FIG. 2, in accordance with one embodiment of the present invention.

Referring now to FIG. 3, a cross-sectional view of the display panel 15 along the line 260—260 of FIG. 2 is illustrated. A cross-sectional view of the first surface 16, which may include glass, is provided. The light emitting elements 215(1–3) shown in FIG. 3, in one embodiment, lie between the column 230(1–6), which may be an ITO anode rail, for example, and row 225(1), which may be a cathode rail, for example. The cross-sectional view includes the row contact 245(1), which, as described in more detail below, may be a contact pad that is adapted to be coupled to a corresponding contact pad on the back panel 200 (see FIG. 1). In one embodiment, the electrical signals received through the row contact 245(1) are applied to the cathode of each light emitting elements 215(1–3) in the first row 225(1) of the display panel 15. As shown in the cross-sectional view of FIG. 3, the light emitting elements 215(1–3) in the first row 225(1) are isolated from each other by isolation, non-conductive, material 320, such as polyamides or other insulating material.

Figure 4:
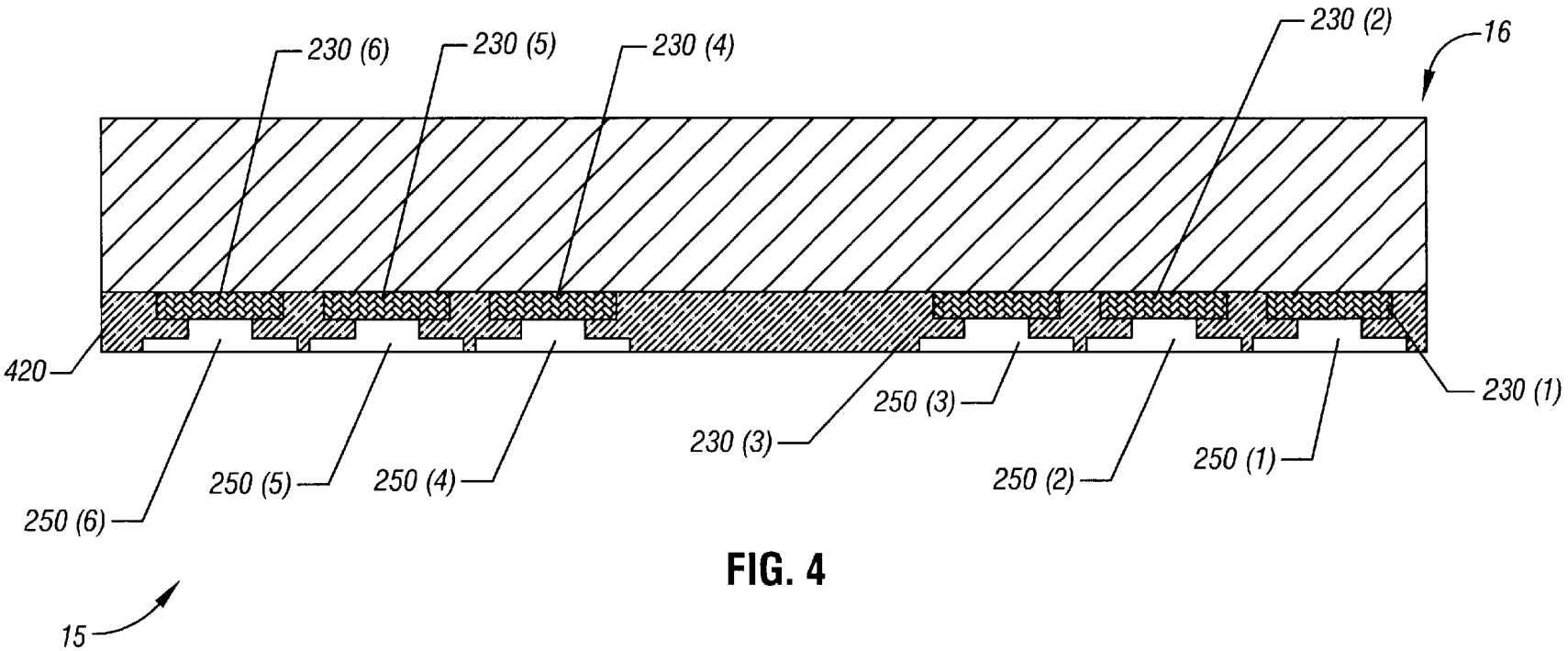
FIG. 4 is an alternative cross-sectional view of the display panel of FIG. 2, in accordance with one embodiment of the present invention.

Referring now to FIG. 4, a cross-sectional view of the front panel 15 along the line 270—270 of FIG. 2 is illustrated. A cross-sectional view of the front panel 15 shows the insulation material 420 that isolates each of the column contacts 250(1–6) from each other, in one embodiment. Each of the column contacts 250(1–6) in the illustrated embodiment is respectively coupled to each of the columns 230(1–6) (i.e., anode rails). The contacts 250(1–6) are adapted to be coupled to corresponding contacts on the first surface 22 of the back panel 20 (see FIG. 1).

While FIGS. 3 and 4 illustrate cross-sectional perspectives of two portions of the display panel 15, it should be appreciated that, in one embodiment, the remaining portions of the display panel 15 may be constructed in a similar fashion as shown in FIGS. 3 and 4. Furthermore, it should be appreciated that the example arrangement of contacts in FIGS. 3 and 4 are for illustrative purposes, and that in alternative embodiments, other arrangements may be employed.

Figure 5:
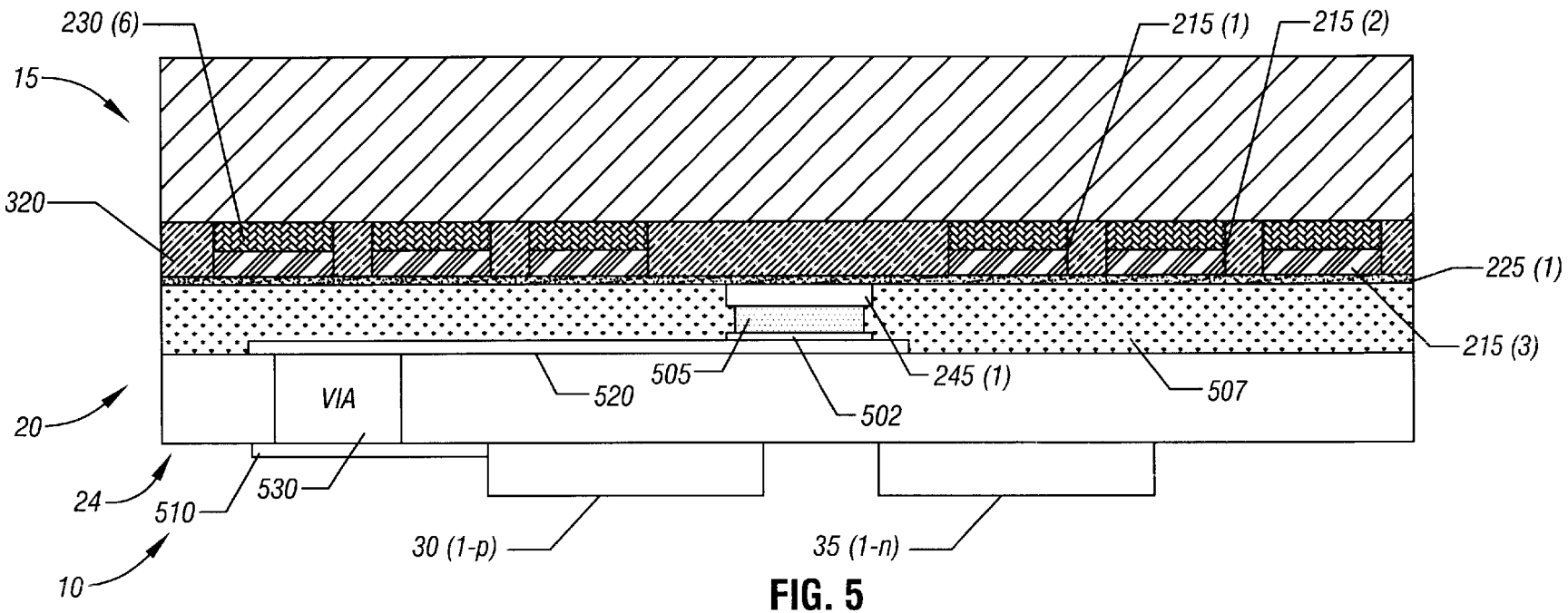
FIG. 5 is a cross-sectional view of the module of FIG. 1, in accordance with one embodiment of the present invention.
Figure 6:
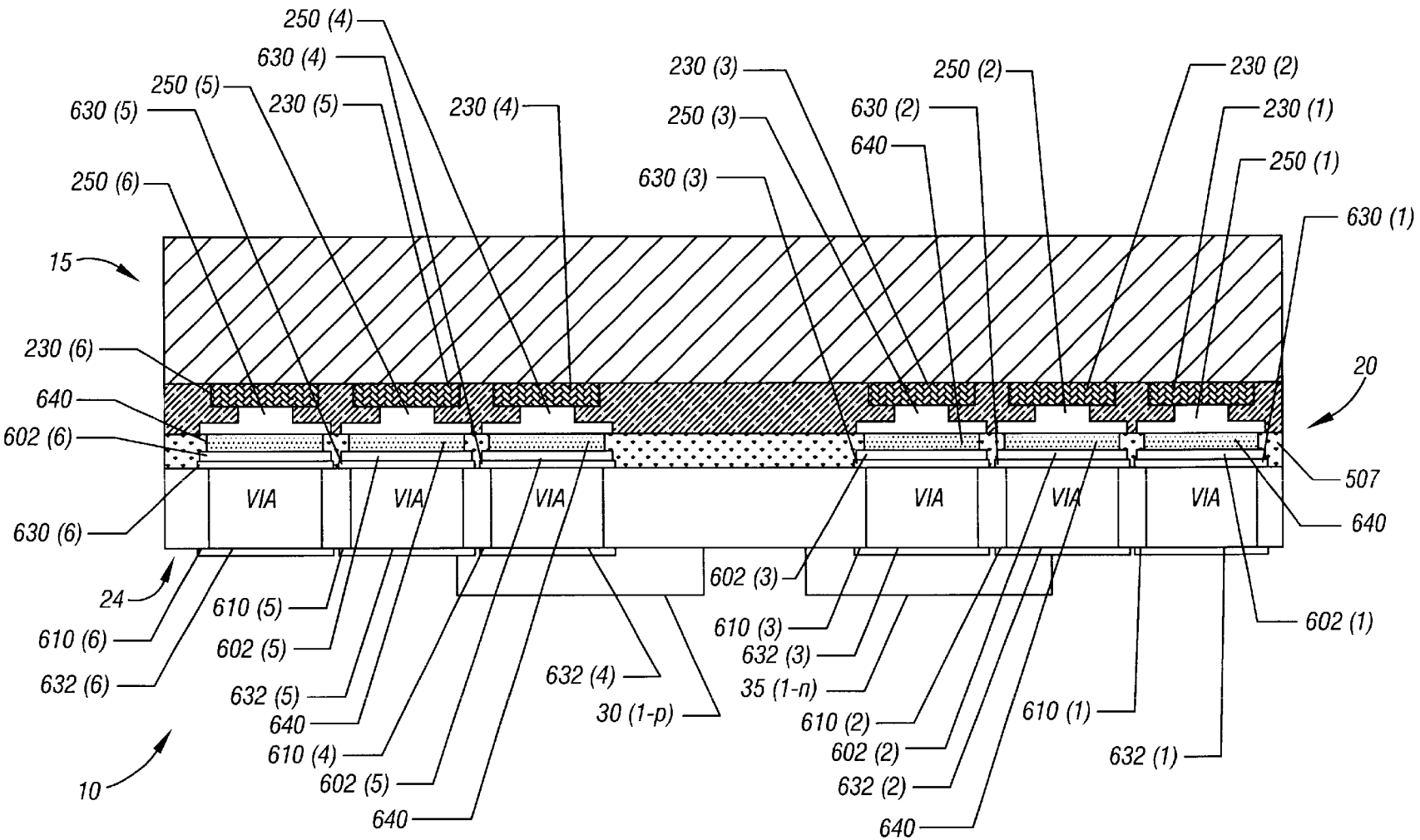
FIG. 6 is an alternative cross-sectional view of the module of FIG. 1, in accordance with one embodiment of the present invention.

Referring now to FIG. 5, a cross-sectional view of the display panel 15 and the back panel 20 along the line 260—260 (see FIG. 2) is illustrated, in accordance with one embodiment of the present invention. For illustrative purposes, as is evident from the like reference numerals, the cross-sectional view of the display panel 15 shown in FIG. 6 is substantially the same view as that of FIG. 3. In one embodiment, one or more of the drivers 30(1–p) and integrated circuits 35(1–n) may be attached to the second surface 24 of the back panel 20 (see also FIG. 1).

In one embodiment, the back panel 20 includes a contact 502 that is adapted to be coupled to the contact 245(1) of the display panel 15. The contacts 245(1) and 502 may be coupled in one of a variety of ways, including by a solder joint 505. For clarity and ease of illustration, only one contact (e.g., contacts 245 and 502) connection between the display panel 15 and the back panel 20 is shown, although those skilled in the art will appreciate that one or more contacts of the display panel 15 may be similarly coupled to one or more corresponding contacts of the back panel 20. In one embodiment, once all of the desired contacts 245(1–p) of the display panel 15 are coupled to the corresponding contacts (e.g., 502) of the back panel 20, one of a variety of filling material 507, such as insulating epoxy, may be applied at the juncture of the two panels 15 and 20.

The one or more drivers 30(1–p) for the display panel 15 may provide an electrical signal to a rail 510 of the back panel 20. The rail 510 may be coupled to another rail 520 of the back panel 20 through an electrically conductive via 530. The electrical signal from the rail 530 may be provided to the row 225(1) (e.g., cathode rail) through the contacts 245(1) and 502. In one embodiment, additional vias may be utilized for providing electrical signals to other row contacts 245(2–p). In another embodiment, the same via may be used to provide electrical signals to other redundant contacts of the same row. In one embodiment, the back panel 20 may include at least one via for each row contact **245(2–*p*)**.

It should be appreciated that a wide range of "circuit board" technologies may be used to fabricate interconnection structures such as those illustrated here for the back panel. One or more embodiments of the present invention described herein are not limited to the description provided herein, and may include other well-known approaches. For example, the via 530 may be filled or open. It may be desirable to avoid the vias in some embodiments, and, instead, make the interconnections between the two surfaces at the edges of the back panel 20.

Referring now to FIG. 6, a cross-sectional view of the display panel 15 and the back panel 20 along the line 270—270 (see FIG. 2) is illustrated, in accordance with one embodiment of the present invention. For illustrative purposes, as is evident from the like reference numerals, the cross-sectional view of the display panel 15 of FIG. 4 is substantially the same as that of FIG. 4. In the illustrated embodiment of FIG. 6, one or more of the drivers **30(1–*p*) and integrated circuits 35(1–*n*) are attached to the second surface 24 (see also FIG. 1) of the back panel 20 (see also FIG. 1**).

In one embodiment, the back panel 20 includes a plurality of contacts 602(1–6) that are adapted to be coupled to each of contacts 250(1–6) of the display panel 15. In one embodiment, the contacts 250(1–6) and 602(1–6) may be coupled to each other in one of a variety of ways, including by solder joints 640. For clarity and ease of illustration, the connection between the display panel 15 and the back panel 20 is shown through only six contacts 250(1–6) and 602 (1–6), although those skilled in the art will appreciate that other contacts **250(7–*r*) (see FIG. 2) of the display panel 15 may be similarly coupled to one or more corresponding contacts of the back panel 20. In one embodiment, once the desired contacts 250(1–*r*) of the display panel 15 are coupled to the corresponding contacts (e.g., 602(1–6)) of the back panel 20, one of a variety of filling material 507, such as insulating epoxy, may be applied at the juncture of the two panels 15 and 20**.

The one or more drivers **30(1–*p*) for the display panel 15 may provide an electrical signal to any one of a plurality of rails 610(1–6) of the back panel 20, in one embodiment. Each rail 610(1–6) may be coupled to a corresponding rail 630(1–6) of the back panel 20 through a corresponding via 632(1–6). For ease of illustration, not all of the portions of the interconnection between the rails 610(1–6) and the one or more drivers 30(1–*p*) may be shown, as such interconnections may be made by one skilled in the art. The electrical signal from each rail 630(1–6) may be provided to each corresponding column 230(1–6) through the respective contacts 602(1–6) and 250(1–6). In one embodiment, additional vias may be utilized for providing electrical signals to other contacts 250(7–*r*) (see FIG. 2). In one embodiment, the back panel 20 may include at least one via for each contact 250(7–*r*)**. In another embodiment, one via may provide electrical signals to other redundant contacts of the same column.

The cross-sectional views provided in FIGS. 3–6 are illustrative only and may not necessarily be drawn to scale. Those skilled in the art may appreciate that the desired size of selected elements shown in the cross-sectional views of FIGS. 3–6 may vary from one implementation to another.

Figure 7:
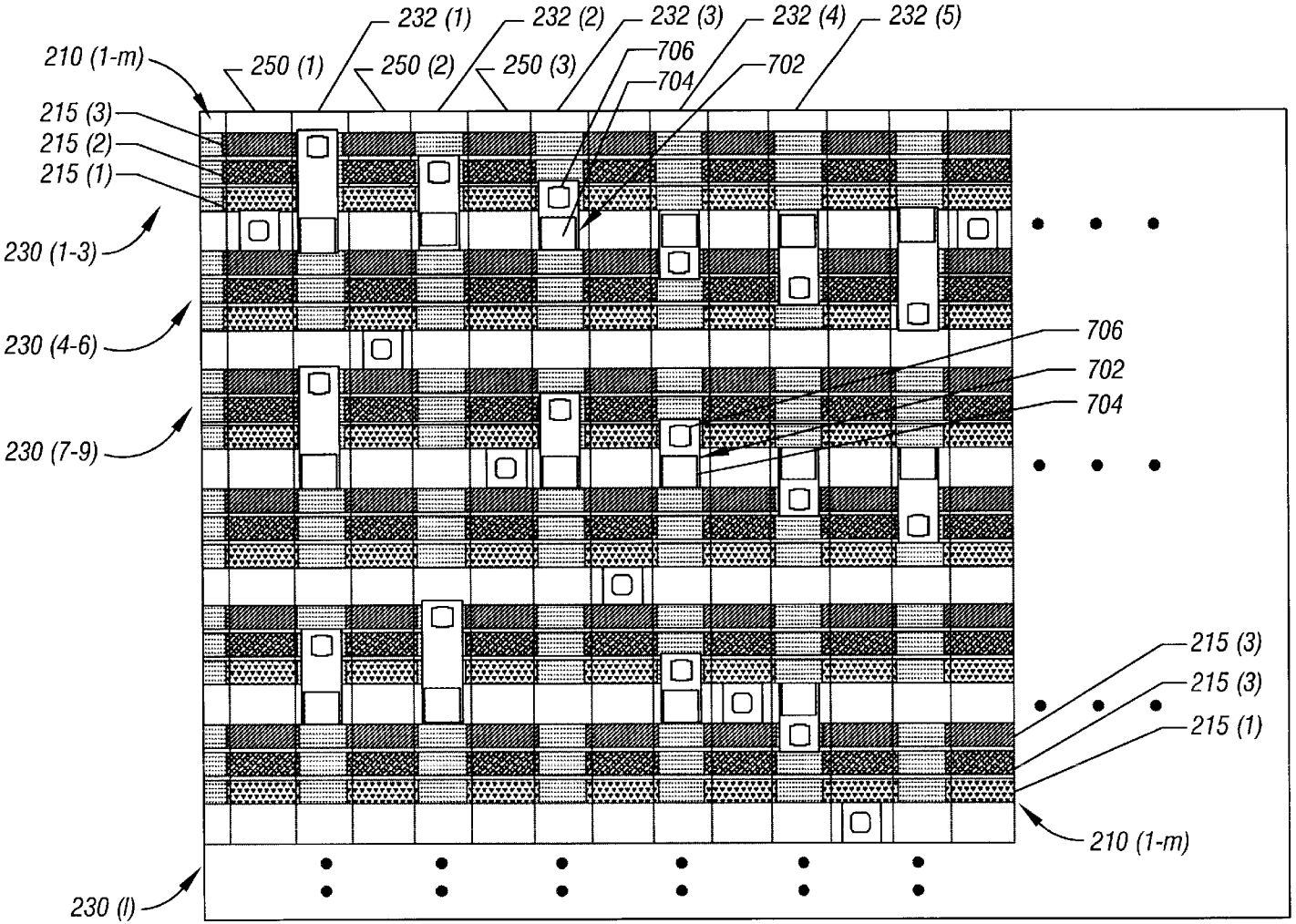
FIG. 7 depicts an alternate embodiment of a display panel that may be employed by the module of FIG. 1, in accordance with the present invention.

Referring now to FIG. 7, a plane view of the display module 15 of the module 10 of FIG. 1 is illustrated, in accordance with one embodiment of the present invention. FIG. 7 shows one example of a redundant contact arrangement that may be employed to attach the display panel 15 to the back panel 20 of the module 10 of FIG. 1, although in other embodiments, any variety of arrangements may be employed, depending on, for example, the technology design rules that may be available to lay out the contacts, the design rules and number of layers available on the back panel 20 (see FIG. 1), and/or electrical performance details associated with the front panel 15 (see FIG. 1), details such as circuit resistances, capacitances, operating frequency, current requirement, and the like.

The display panel 15 in the illustrated embodiment includes a two-dimensional array of a plurality of pixels **210(1–*m*), where each pixel 210(1–*m*) is formed of three sub-pixels 215(1–3). In the example arrangement of FIG. 7, the contacts 702 are repeated every seven pixels 210(1–*m*). In one embodiment, electrical signal may be provided to the anode of selected sub-pixels 215(1–3)) by a contact 702 that may be coupled to a corresponding contact pad 704 on the back panel 20 (see FIG. 1). In one embodiment, at least one via 706 is provided for delivering an electrical signal to the anode of the selected sub-pixel 215(1–3) in the manner shown in FIG. 7. The redundant arrangement shown in FIG. 7** may provide one or more of the advantages described above. The degree of redundancy (shown here to be repeated every seven pixels) is not limited to this example, and could be greater or lesser, depending on one or more of the conditions described above.

In accordance with one or more embodiments of the present invention, an array contacting architecture may provide certain desired advantages over the conventional edge connection configurations. For example, in one embodiment, an array contact configuration may provide reduced line resistances and capacitances for improved performances. In another instance, array contact arrangements may be more conducive for constructing larger, more efficient display arrays. Additionally, an array contact configuration may reduce the need for a "window" frame around the periphery of the display that is otherwise common in edge connection configurations.

Integrating the drivers **30(1–*p*) and/or integrated circuits in accordance with one or more embodiments of the present invention may reduce the footprint on the back panel 20 and may prove to be advantageous when the module 10 is utilized in portable devices, such as mobile phones, personal digital assistants, music players, laptops, and the like. In some cases, integrating the drivers 30(1–*p*) and other integrated circuits 35(1–*n*) on the back panel 20 of the module 10** may also reduce manufacturing costs.

Figure 8:
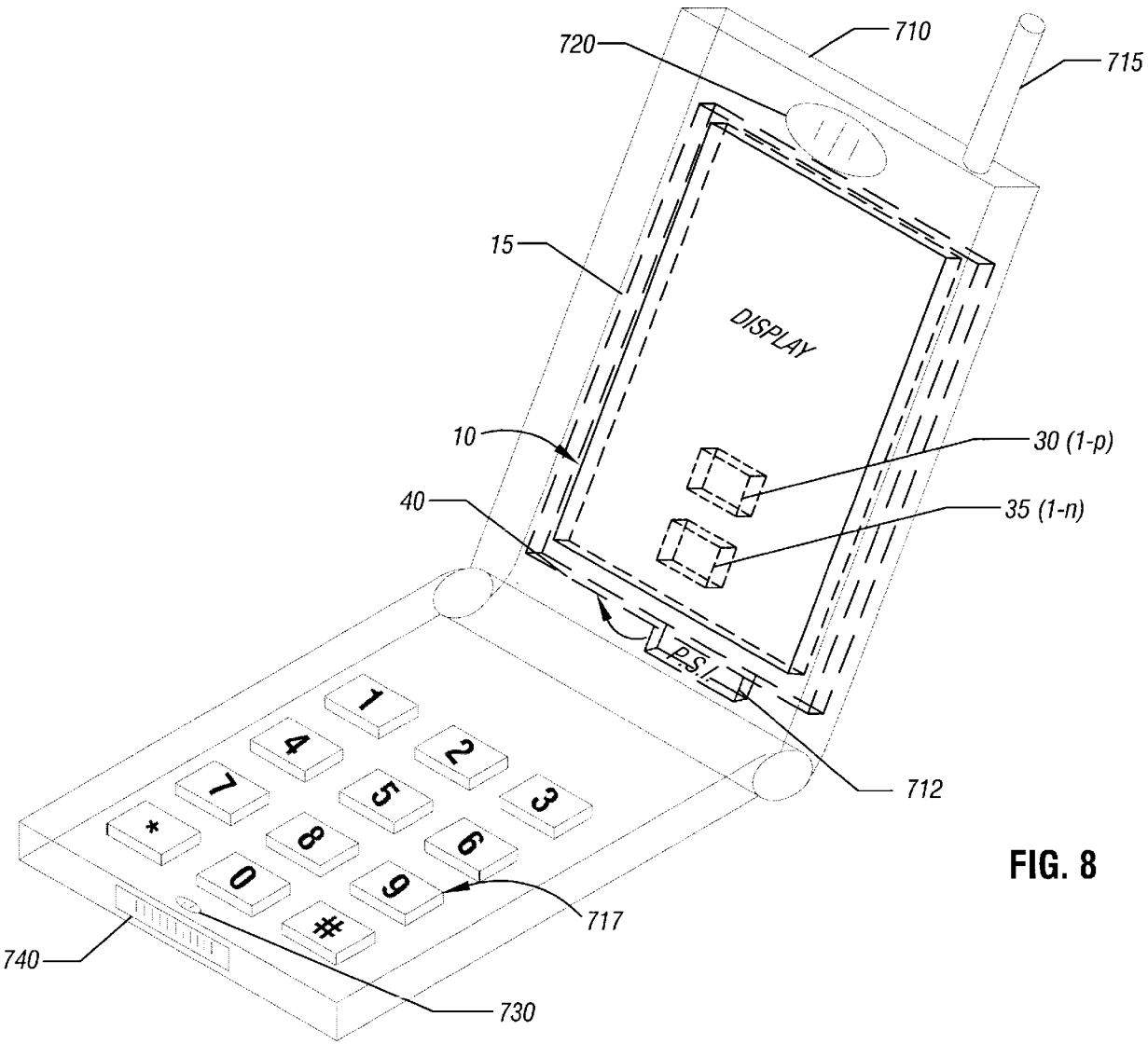
FIG. 8 is an isometric view of a portable device employing the module of FIG. 1, in accordance with one embodiment of the present invention.

Referring now to FIG. 8, an isometric view of a portable device 710 employing the module 10 of FIG. 1 is illustrated, in accordance with one embodiment of the present invention. Although not so limited, in the illustrated embodiment, the portable device 710 is a cellular telephone. A "portable device" in one embodiment may be any device that is battery-powered, for example, and may include music players, cameras, portable movie players, laptop computers, personal digital assistants, paging devices, and the like. The display panel 15 of the module 10 in the illustrated embodiment serves as the display for the portable device 710. In one embodiment, the size of the display panel 15 of the module 10 may be increased to any desirable size, based on the available area.

In one embodiment, the desired integrated circuits **35(1–*n*) for the portable device 710 may be coupled to the second surface 24 (see FIG. 1) of the back panel 20 of the module 10. Additionally, in one embodiment, one or more drivers 30(1–*p*) for driving the display panel 15 may be attached to the second surface 24 of the back panel 20 of the module 10. As mentioned above, allowing integrated circuits 35(1–*n*) and/or 30(1–*p*) to be attached to the second surface 24 of the pack panel 20** may result in cost savings, as well as improved performance because of reduced line capacitance and resistance.

The portable device 710, in one embodiment, includes a power supply interface 712 for interfacing with the module 10 through the connector 40. The power supply interface 710 in one embodiment may include a battery. The portable device 710 may include an antenna 715 for transmitting and receiving signals using radio frequency. In one embodiment, the portable device 710 may include an input keypad 717 for allowing a user to input telephone numbers or to select one or more features supported by the portable device 710. The portable device 710 may include a speaker 720 and a microphone 730 for respectively outputting and receiving audio signals to and from the user. In one embodiment, the portable device 710 may include a recharging port 740 for recharging the power supply source of the portable device 710, such as a rechargeable battery.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus, comprising:

a first panel comprising one or more contacts; and a display panel comprising two or more light emitting elements disposed between two layers of conductive material and one or more contacts arranged on said two layers of conductive material to deliver current to the light emitting elements through said two layers of conductive material, wherein the contacts of the display panel are interspersed between said light emitting elements and are surface mounted to the contacts of the first panel.

2. The apparatus of claim 1, wherein the first panel comprises the one or more contacts in an array arrangement.

3. The apparatus of claim 1, wherein the display panel comprises the one or more contacts in an array arrangement.

4. The apparatus of claim 1, wherein the display panel comprises three or more light emitting elements arranged in a two-dimensional array format.

5. The apparatus of claim 1, the first panel having a first surface and an opposite surface, wherein the first panel further comprises the one or more contacts on the first surface and one or more drivers on the opposite surface for driving the light emitting elements.

6. The apparatus of claim 1, the first panel having a first and a second end, wherein the first panel comprises a connector on the first end to interface with an external device.

7. The apparatus of claim 1, the first panel having a first surface and an opposite surface, wherein the first panel further comprises the one or more contacts on the first surface and one or more integrated circuits on the opposite surface.

8. The apparatus of claim 1, wherein the display panel comprises one or more organic light emitting diodes.

9. The apparatus of claim 8, wherein the display panel comprises redundant contacts to provide current to the one or more organic light emitting diodes.

10. A method, comprising:

arranging one or more contacts on a first panel;

disposing one or more light omitting elements between two layers of conductive material on a second panel;

arranging one or more contacts on said two layers of conductive material to deliver current to said one or more light emitting elements through said two layers of conductive material, said contacts on said second panel being interspersed between said light emitting elements; and combining the first panel to the second panel, wherein the contacts of the first panel are surface mounted to the contacts of the second panel.

11. The method of claim 10, wherein arranging the one or more contacts comprises arranging the one or more contacts in a two-dimensional array in the first panel.

12. The method of claim 10, wherein arranging the one or more contacts on the second panel comprises arranging the one or more contacts to deliver current to one or more organic light emitting diodes.

13. The method of claim 12, wherein arranging the one or more organic light emitting diodes comprises one or more red, green, and blue organic light emitting diodes.

14. The method of claim 10, wherein the first panel comprises a first surface and an opposite surface, wherein arranging the one or more contacts comprises arranging the one or more contacts on the first surface of the first panel.

15. The method of claim 14, further comprising coupling one or more drivers on the opposite surface of the first panel to drive the one or more light emitting elements.

16. The method of claim 15, further comprising providing driving the one or more light emitting elements using the one or more drivers.

17. The method of claim 16, wherein the first panel comprises one or more vias, wherein driving the one or more light emitting elements comprises driving the one or more light emitting elements through the vias in the first panel.

18. The method of claim 10, the first panel having a first and a second end, further comprising providing a connector at the first end of the first panel to interface with an external device.

19. The method of claim 10, wherein arranging the one or more contacts on the second panel comprises arranging the one or more contacts to provide redundant coverage for the one or more light emitting diodes.

20. An apparatus, comprising:

a first panel having a ball grid array of contacts; and a display panel having a ball grid array of contacts that are interspersed among one or more organic light emitting diodes that are disposed between two layers of conductive material, said display contacts arranged on said two layers of conductive material to deliver electrical signals through said two layers of conductive material to said organic light emitting diodes, wherein the ball grid array of contacts of the display panel are coupled to the ball grid array of contacts of the first panel.

21. The apparatus of claim 20, wherein each organic light emitting diode comprises an anode and a cathode, wherein the display panel comprises one or more row and column contacts arranged in an array and wherein the row contacts provide current to the anode and the column contacts provide current to the cathode of each organic light emitting diode.

22. The apparatus of claim 20, wherein the display panel comprises redundant contacts to provide electrical signals to the organic light emitting diodes.

23. The apparatus of claim 20, wherein the first panel comprises a first surface and a second surface, wherein the first surface contains the ball grid array of contacts and the second surface contains one or more drivers for providing electrical signals to the ball grid array of contacts.

24. A method, comprising:

providing an array of contacts on a first panel;

providing one or more organic light emitting diode pixels and an array of contacts on a display panel, said one or more light emitting diode pixels being disposed between two layers of conductive material and said array of contacts on said display panel being interspersed among said light emitting diode pixels;

coupling said contacts to said two layers of conductive material;

containing the first array of contacts on the display panel to the array of contacts on the first panel by applying heat; and enabling application of electrical signals to the organic light emitting diode pixels through the first panel.

25. The method of claim 24, wherein the first panel has a first and an opposite surface, wherein providing the array of contacts comprises providing an array of contacts on the first surface.

26. The method of claim 25, further comprising coupling one or more drivers to the opposite surface of the first panel to drive the organic light emitting diode pixels.

27. The method of claim 24, wherein the first panel has a first and a second end, further comprising providing a connector at the first end of the first panel.

28. A portable device, comprising:

an interface; and a module communicatively coupled to the interface, the module comprising:

a first panel having an array of contacts; and a display panel having one or more light emitting elements disposed between two layers of conductive material and an array of contacts arranged on said two layers of conductive material to deliver electrical signals to the light emitting elements through said two layers of conductive material, wherein the array of contacts of the display panel are surface mounted to the array contacts of the first panel, and said array of contacts of the display panel are interspersed among said light emitting elements.

29. The portable device of claim 28, wherein the first panel comprises a first and an opposite surface, wherein the first surface comprises the array of contacts and the opposite surface comprises a driver coupled to the array of contacts.

30. The portable device of claim 29, wherein first panel comprises one or more integrated circuits coupled to the opposite surface of the first panel.

* * * * *